US012514366B2

(12) United States Patent
Brolley

(10) Patent No.: US 12,514,366 B2
(45) Date of Patent: Jan. 6, 2026

(54) MOUNT ASSEMBLY FOR A SOFT CLOSE MECHANISM OF A SLIDE ASSEMBLY

(71) Applicant: Haier US Appliance Solutions, Inc., Wilmington, DE (US)

(72) Inventor: Justin James Brolley, New Albany, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 264 days.

(21) Appl. No.: 18/460,191

(22) Filed: Sep. 1, 2023

(65) Prior Publication Data

US 2025/0072713 A1 Mar. 6, 2025

(51) Int. Cl.

| | |
|---|---|
| ***A47L 15/50*** | (2006.01) |
| ***A47B 88/467*** | (2017.01) |
| ***A47B 88/477*** | (2017.01) |
| ***A47B 88/487*** | (2017.01) |
| *A47B 88/40* | (2017.01) |
| *A47B 88/493* | (2017.01) |

(52) U.S. Cl.

CPC ..... *A47B 88/467* (2017.01); *A47B 88/477* (2017.01); *A47B 88/487* (2017.01); *A47L 15/507* (2013.01); *A47B 2088/401* (2017.01); *A47B 88/493* (2017.01); *A47B 2210/0094* (2013.01); *A47L 15/502* (2013.01)

(58) Field of Classification Search

CPC ... A47B 88/467; A47B 88/473; A47B 88/477; A47B 88/427; A47B 88/487; A47B 88/493; A47B 2210/0094; A47B 2210/0059; A47B 2088/401; A47L 15/507; A47L 15/502

See application file for complete search history.

(56) References Cited

U.S. PATENT DOCUMENTS

| | | | |
|---|---|---|---|
| 7,377,500 | B2 | 5/2008 | Tomiji et al. |
| 7,607,444 | B2 | 10/2009 | Gunnerson et al. |
| 7,945,993 | B2 | 5/2011 | Tomioka et al. |
| 8,205,951 | B2 | 6/2012 | Boks |
| 8,387,634 | B2 | 3/2013 | Daising |
| 8,393,693 | B2 | 3/2013 | Juan et al. |
| 8,414,094 | B2 | 4/2013 | Chi et al. |
| 8,419,142 | B2 | 4/2013 | Zimmermann |
| 8,449,051 | B2 | 5/2013 | Lam et al. |

(Continued)

FOREIGN PATENT DOCUMENTS

| | | | | |
|---|---|---|---|---|
| CN | 111616532 A | * | 9/2020 | ..... A47B 88/463 |
| CN | 111657689 A | * | 9/2020 | ..... A47B 88/467 |

(Continued)

*Primary Examiner* — Kimberley S Wright

(74) *Attorney, Agent, or Firm* — Dority & Manning, P.A.

(57) ABSTRACT

A slide assembly may include an inner rail. The slide assembly may also include an outer rail that may be slidably attached to the inner rail. The outer rail may be extended between a first end and a second end. The slide assembly may further include a soft close mechanism that may include an actuator to dampen movement of the slide assembly. The slide assembly may also include a mount assembly. The mount assembly may include an end cap that may be attached to the first end of the outer rail. The mount assembly may also include a first mount body attached to the outer rail. The soft close mechanism may be mounted to the first mount body.

20 Claims, 8 Drawing Sheets

(56) References Cited

U.S. PATENT DOCUMENTS

| | | | | |
|---|---|---|---|---|
| 8,459,758 | B2 | 6/2013 | Rechberg et al. | |
| 8,511,764 | B1 | 8/2013 | Chen | |
| 8,888,200 | B2 | 11/2014 | Sato | |
| 8,894,166 | B2 * | 11/2014 | Laible | F25D 25/025 312/319.1 |
| 8,939,525 | B1 | 1/2015 | Chen | |
| 9,032,978 | B2 | 5/2015 | Kiechle et al. | |
| 9,049,977 | B2 | 6/2015 | Jobst et al. | |
| 9,055,851 | B2 | 6/2015 | Johansson | |
| 9,107,500 | B2 * | 8/2015 | Zimmermann | A47B 88/463 |
| 9,364,089 | B1 | 6/2016 | Chen et al. | |
| 9,388,619 | B2 | 7/2016 | Park et al. | |
| 9,420,882 | B2 | 8/2016 | Garcia et al. | |
| 9,486,077 | B2 | 11/2016 | Brock | |
| 9,642,460 | B2 | 5/2017 | Chen et al. | |
| 9,968,193 | B1 | 5/2018 | Chen et al. | |
| 10,051,963 | B2 | 8/2018 | Azkue et al. | |
| 10,058,176 | B2 | 8/2018 | Rehange | |
| 10,159,398 | B2 | 12/2018 | Wilson et al. | |
| 10,165,856 | B2 | 1/2019 | Gleixner et al. | |
| 10,292,494 | B1 | 5/2019 | Huang et al. | |
| 10,638,838 | B2 | 5/2020 | Stöckli et al. | |
| 10,667,608 | B2 | 6/2020 | Rehage et al. | |
| 10,736,421 | B2 | 8/2020 | Liao et al. | |
| 10,758,043 | B2 | 9/2020 | Pohlmann | |
| 11,039,688 | B2 | 6/2021 | Pecar et al. | |
| 11,317,783 | B2 | 5/2022 | Scalf et al. | |
| 11,395,546 | B2 | 7/2022 | Lee et al. | |
| 11,406,186 | B2 | 8/2022 | Chen | |
| 2004/0163687 | A1 | 8/2004 | Son et al. | |
| 2007/0046159 | A1 * | 3/2007 | Hoffman | A47B 88/467 312/333 |
| 2008/0067905 | A1 | 3/2008 | Guiles | |
| 2010/0244642 | A1 | 9/2010 | Radusin et al. | |
| 2015/0272325 | A1 * | 10/2015 | Brock | A47B 88/493 384/18 |
| 2016/0270532 | A1 * | 9/2016 | Gleixner | A47B 88/467 |
| 2019/0226259 | A1 | 7/2019 | Gherardi | |
| 2020/0115945 | A1 | 4/2020 | Akca et al. | |
| 2021/0212461 | A1 | 7/2021 | Stuffel et al. | |
| 2022/0202271 | A1 | 6/2022 | Tütek | |
| 2022/0240672 | A1 * | 8/2022 | Duggins | A47B 88/467 |

FOREIGN PATENT DOCUMENTS

| | | | | |
|---|---|---|---|---|
| DE | 102013211549 | B4 * | 9/2017 | A47L 15/507 |
| WO | WO2009141307 | A1 | 11/2009 | |
| WO | WO2012119845 | A1 | 11/2015 | |
| WO | WO2015167853 | A1 | 11/2015 | |
| WO | WO2018082314 | A1 | 5/2018 | |
| WO | WO2018082804 | A2 | 5/2018 | |
| WO | WO2019223972 | A1 | 11/2019 | |
| WO | WO2020007469 | A1 | 1/2020 | |
| WO | WO2022030720 | A1 | 2/2022 | |

* cited by examiner

MOUNT ASSEMBLY FOR A SOFT CLOSE MECHANISM OF A SLIDE ASSEMBLY

FIELD

The present subject matter relates generally to a slide assembly, and more particularly, to a mount assembly for mounting a soft close mechanism to a slide assembly of a dishwashing appliance.

BACKGROUND

Dishwashing appliances generally include a tub that defines a wash chamber. Dish racks can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwasher appliances include slide assemblies for supporting the one or more dish racks within the wash chamber and enabling movement of the dish racks in and out of the wash chamber. Often, the one or more dish racks are designed to be as large as possible, for instance, to maximize a number of articles that may be loaded into the one or more dish racks. As a result, the space within the wash chamber for the slide assemblies, and for features thereof, for example, may be limited. Nonetheless, the size of a dish rack and the mass of articles loaded therein may place significant strain on any slide assembly and the articles, especially when sliding the dish rack back into the tub. For instance, abrupt or hard contact between the dish rack and the tub may risk damaging the slide assembly or articles within the dish rack.

Accordingly, a dishwashing appliance that includes one or more features to mitigate damage or improve durability (e.g., within a compact or space-efficient arrangement) would be useful.

BRIEF DESCRIPTION

Aspects and advantages of the invention will be set forth in part in the following description, or may be apparent from the description, or may be learned through practice of the invention.

In one exemplary embodiment, a dishwashing appliance is provided. The dishwashing appliance may define a vertical direction, a lateral direction, and a transverse direction. The dishwashing appliance may include a tub defining a wash chamber. The dishwashing appliance may also include a rack assembly to load articles within the dishwashing appliance. The dishwashing appliance may further include a slide assembly mounted to the tub to transition the rack assembly between an extended loading position and a retracted position. The slide assembly may include an inner rail attached to the tub. The slide assembly may also include an outer rail slidably attached to the inner rail. The outer rail may be extended between a first end and a second end approximately along the transverse direction. The slide assembly may also include a soft close mechanism that may include an actuator to dampen movement of the slide assembly. The slide assembly may further include a mount assembly. The mount assembly may include an end cap attached to the first end of the outer rail. The mount assembly may also include a first mount body attached to the outer rail. The soft close mechanism may be mounted to the first mount body.

In another exemplary embodiment, a slide assembly is provided. The slide assembly may include an inner rail. The slide assembly may also include an outer rail slidably attached to the inner rail. The outer rail may be extended between a first end and a second end. The slide assembly may also include a soft close mechanism that may include an actuator to dampen movement of the slide assembly. The slide assembly may further include a mount assembly. The mount assembly may include an end cap attached to the first end of the outer rail. The mount assembly may also include a first mount body attached to the outer rail. The soft close mechanism may be mounted to the first mount body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
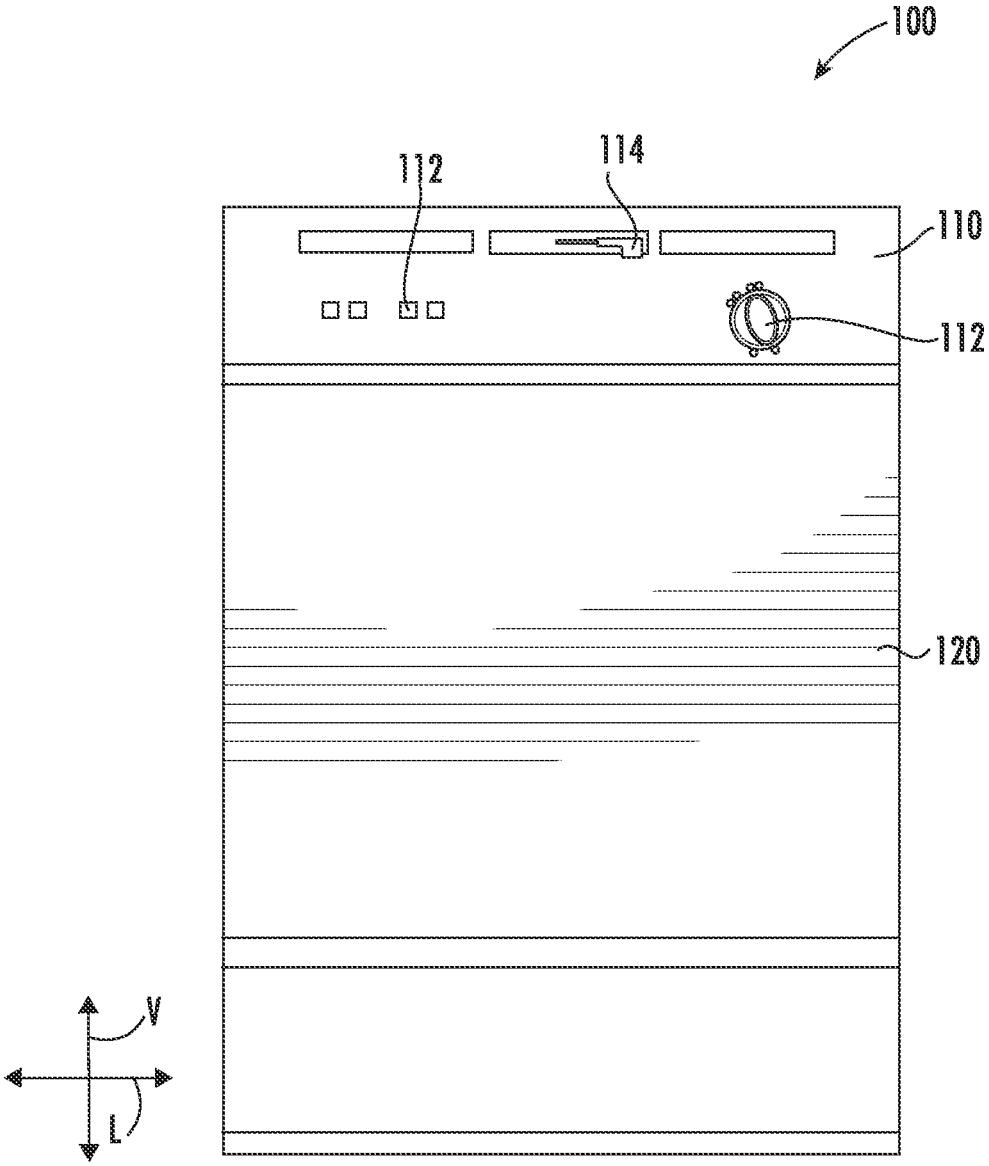
FIG. 1 provides a front elevation view of a dishwasher appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
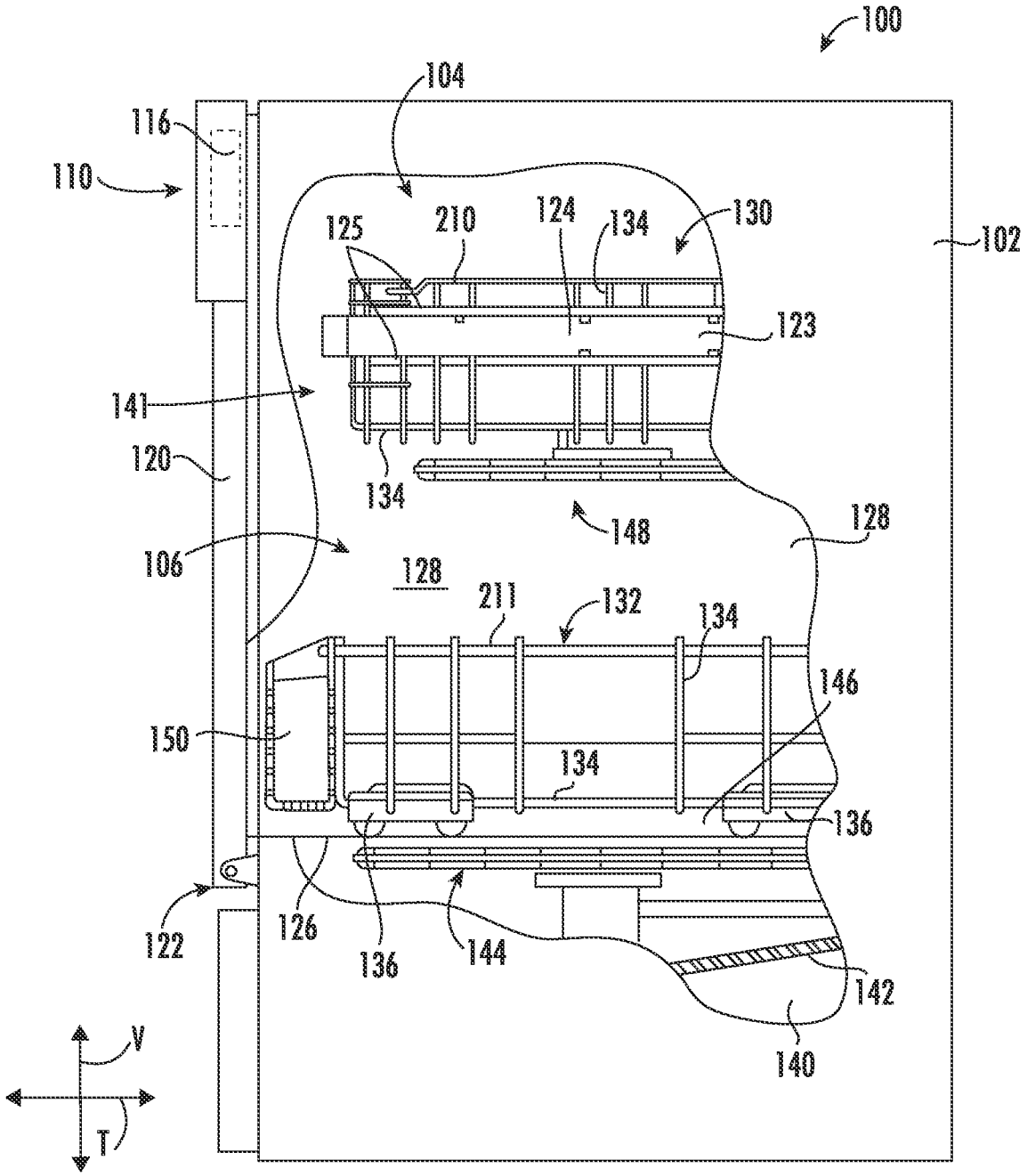
FIG. 2 provides a side, partially cut away view of the exemplary dishwasher appliance of FIG. 1.

Referring now to FIGS. 1 and 2, a dishwasher appliance 100 according to one or more exemplary embodiments of the present subject matter is provided. Specifically, FIG. 1 provides a front elevation view of the dishwasher appliance 100 and FIG. 2 provides a side, partially cut away view of the dishwasher appliance 100 of FIG. 1. As depicted, the dishwasher appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwasher appliance 100 may include a cabinet 102 having a tub 104 therein that defines a wash chamber 106. The tub 104 may include a front opening and a door 120 that may be hinged at a bottom 122 for movement between a normally closed vertical position, e.g., FIGS. 1 and 2, wherein the wash chamber 106 is sealed shut for washing operation, and a horizontal open position (not depicted), wherein the loading and unloading of articles from the dishwasher appliance 100 may occur. In some instances, such as depicted in FIG. 1, the dishwasher appliance 100 may include a latch 114 that may be used to lock and unlock the door 120 such that access to the wash chamber 106 may be permitted or restricted.

In addition, the dishwasher appliance 100 may include one or more rack assemblies, such as an upper rack assembly 130 and a lower rack assembly 132, that may be used to load articles in the dishwasher appliance 100. In some embodiments, the upper rack assembly 130 may be mounted within the dishwasher appliance 100 in an upper region 141 of the wash chamber 106, e.g., above the lower rack assembly 132 with respect to the vertical direction V. The rack assemblies 130, 132 may each be adapted for movement substantially along the transverse direction T between an extended loading position (not shown) in which the respective rack assembly 130, 132 is positioned substantially outside the wash chamber 106 and a retracted position, e.g., FIGS. 1 and 2, in which the respective rack assembly 130, 132 may be located entirely within the wash chamber 106. As illustrated in FIG. 2, the movement of the upper rack assembly 130 may be facilitated by a pair of slide assemblies 124 that may be positioned at opposing lateral sides of the upper rack assembly 130. Additionally, the movement of the lower rack assembly 132 may be facilitated by a pair of roller assemblies 136 that may be positioned at opposing lateral sides of the lower rack assembly 132.

One of ordinary skill in the art would understand that the pair of slide assemblies 124 and the pair of roller assemblies 136 are provided by way of example only. For instance, in alternative exemplary embodiment, the movement of the upper rack assembly 130 and the lower rack assembly 132 may each be facilitated by a respective pair of slide assemblies such as the pair of slide assemblies 124.

The rack assemblies 130, 132 may each include a dish rack for holding articles therein, e.g., for the cleaning of the articles. For instance, the upper rack assembly 130 may include an upper dish rack 210 and the lower rack assembly 132 may include a lower dish rack 211. The dish racks 210, 211 may each include a plurality of elongated member or rails 134 that may each be extended in the lateral direction L, the transverse direction T. and the vertical direction V. The plurality of rails 134 may be wires, rods, or any other suitable member, which may be fabricated into a lattice structure to form the shape of the respective dish rack 210, 211.

As depicted and described herein, the pair of slide assemblies 124 may include or be provided as a pair of ball bearing slide assemblies 124 that each include an inner rail 123 and outer rail 125. The inner rail 123 may be mounted to, fixed to, or attached to, a lateral tub side wall 128 of the tub 104. The outer rail 125 may be attached to or mounted to a respective lateral side of a corresponding dish rack (e.g., the upper dish rack 210). In some embodiments, the outer rails 125 are slidably mounted onto the respective inner rail 123 such that the outer rails 125 may slide along the respective inner rail 123, e.g., to move the upper rack assembly 130 between the extended loading position and the retracted position. Additionally or alternatively, in some embodiments, the pair of slide assemblies 124 include an intermediate rail 127. As will be further described below, the intermediate rail 127 may include one or more rail caps 222 that each may be attached to a respective transverse end of the intermediate rail 127. Each rail cap 222 may be used to cover the respective transverse end of the intermediate rail 127. For instance, in some embodiments, the intermediate rail 127 may be constructed from a material, for example, metal that may include exposed edges. Each rail cap 222 may be used to protect a user from the exposed metal edges of the intermediate rail 127.

In addition, lower guides 126 may be positioned in opposing manner of the sides of chamber 106 and provide a ridge or shelf for roller assemblies 136 so as to support and provide movement for the lower rack assembly 132.

Optionally, a silverware basket 150 may be removably attached to the lower rack assembly 132 for placement of silverware, small utensils, and the like, which are too small to be accommodated by the upper rack assembly 130 and the lower rack assembly 132.

Further, the dishwasher appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the upper rack assembly 130. In addition, the dishwasher appliance 100 may include a mid-level spray assembly 148 that may be located in the upper region 141 of the wash chamber 106 and may attached to, or located in close proximity to, the upper rack assembly 130, e.g., the mid-level spray assembly 148 may be in "close proximity" to the upper rack assembly 130 in that the mid-level spray assembly 148 is closer to the upper rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below the bottom sump portion 142 of the tub 104, as generally recognized in the art. Each spray assembly, e.g., lower spray assembly 144, mid-level spray assembly 148, and upper spray assembly, may include an arrangement of discharge ports or orifices for directing washing liquid onto dishes or other articles located in the upper rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwasher appliance 100 may further be equipped with a controller 116 to regulate operation of dishwasher appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 116 may be positioned in a variety of locations throughout dishwasher appliance 100. For example, as depicted in FIGS. 1 and 2, the controller 116 may be located within a control panel area 110 of the door 120. In such an embodiment, input/output ("I/O") signals may be routed between the control system and various operational components of dishwasher appliance 100 along wiring harnesses that may be routed through bottom 122 of door 120. In certain embodiments, the control panel area 110 may include input components 112 through which a user may select various operational features and modes and monitor progress of the dishwasher appliance 100. For instance, in some embodiments, input components 112 may be a variety of electrical, mechanical, or electro-mechanical input devices including rotary dials (e.g., FIG. 1), push buttons (e.g., FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 are for illustrative purposes only. For example, different locations may be provided for the input components 112, different configurations may be provided for the upper rack assembly 130 and the lower rack assembly 132, and other differences may be applied as well.

Only a single slide assembly 124 (or elements thereof) is illustrated in FIGS. 3 through 7 and described in the following corresponding paragraphs for the sake of clarity and simplicity. Those of ordinary skill in the art will understand that the exemplary slide assembly 124 shown and described in FIGS. 3 through 7 may be one of a pair. For example, the second slide assembly may be provided opposite the illustrated slide assembly 124. As would be understood, such a second slide assembly may be provided on an opposite tub side wall 128 (e.g., at the same vertical height as the first slide assembly 124). Additionally or alternatively, the second slide assembly may be a substantial duplicate of the illustrated and described slide assembly 124, such as a mirrored version of the illustrated and described slide assembly 124.

Figure 3:
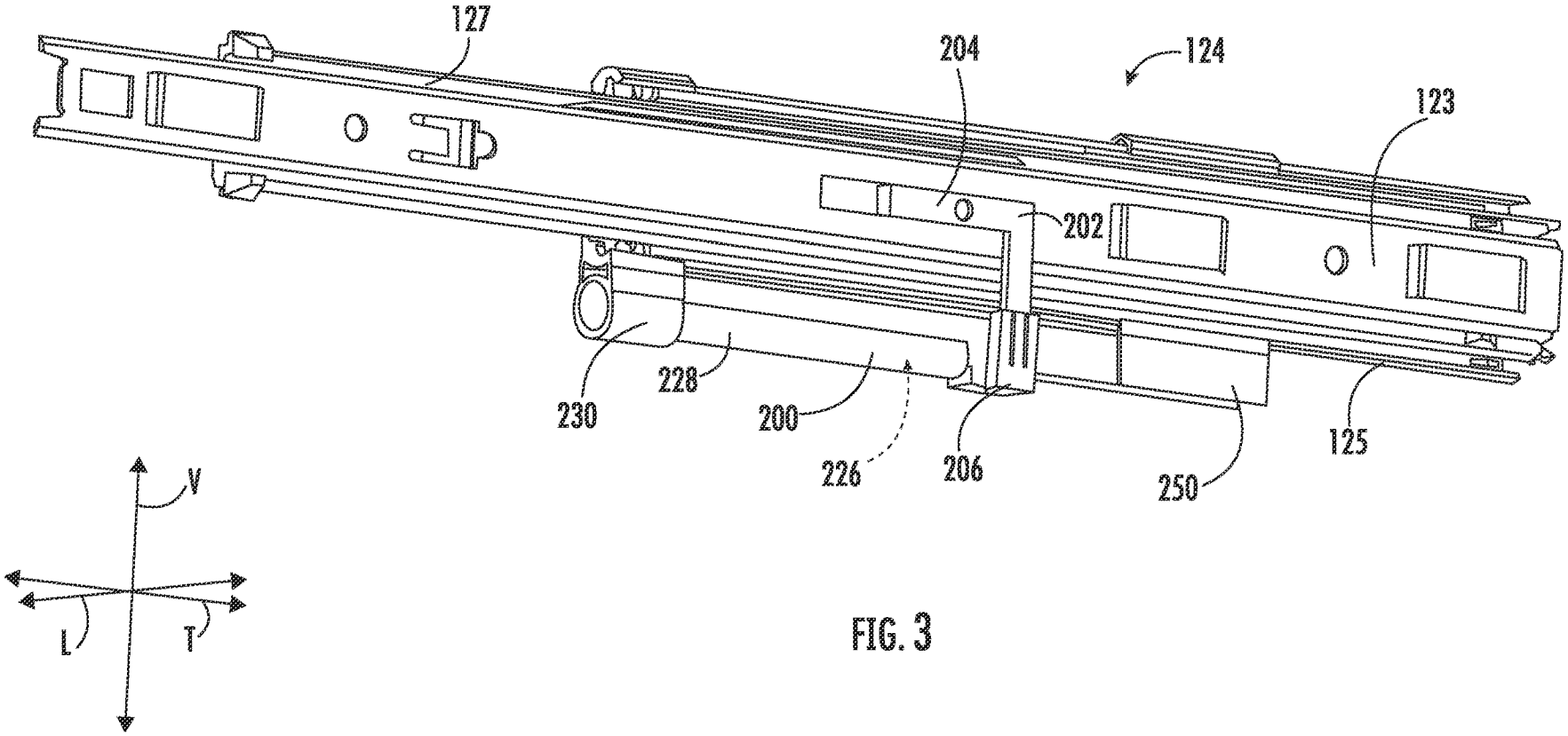
FIG. 3 provides a perspective view of a slide assembly that may be incorporated into a dishwashing appliance, such as the dishwashing appliance of FIG. 1, according to one or more exemplary embodiments of the present subject matter.
Figure 4:
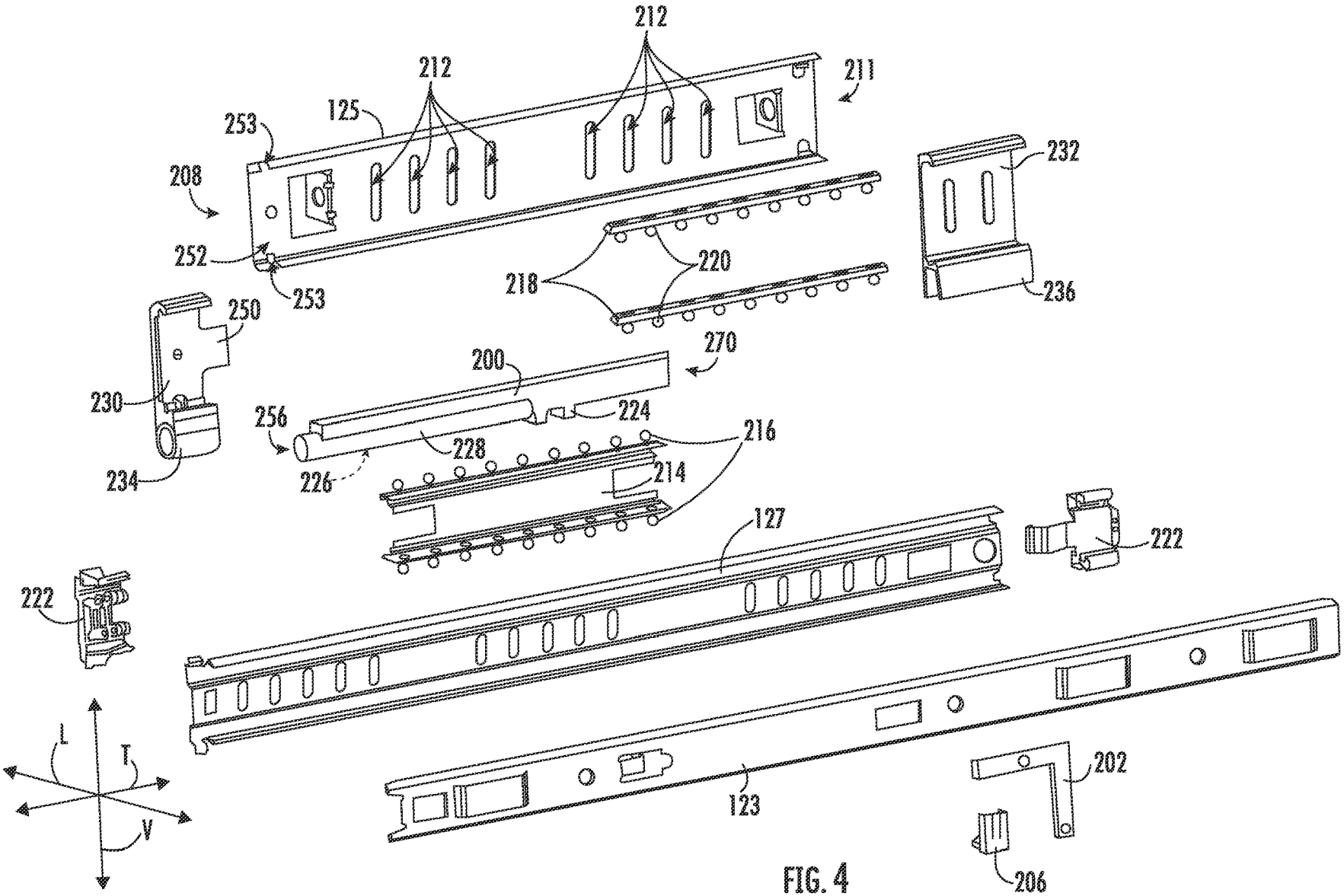
FIG. 4 provides an exploded view of the exemplary slide assembly of FIG. 3.

Referring now to FIGS. 3 and 4, an exemplary slide assembly 124 is provided according to one or more exemplary embodiments of the present subject matter. Specifically, FIG. 3 depicts a perspective view of the slide assembly 124 and FIG. 4 depicts an exploded view of the slide assembly 124. Moreover, the vertical direction V, the lateral direction L, and the transverse direction T described herein, with respect to the various elements of the slide assembly 124 are, except as otherwise indicated, generally understood to correspond to the position of those elements when slide assembly 124 may be attached within wash chamber 106. For example, slide assembly 124 may be attached to the side wall 128 (e.g., via one or more suitable fasteners, screws, bolts, rivets, welds, adhesives, or molded joints). When assembled, slide assembly 124 may extend substantially in or along the transverse direction T. In use, slide assembly 124 may be able to transition, or slide, the upper dish rack 210 substantially in or along the transverse direction T.

In some embodiments, the slide assembly 124 is mounted within the wash chamber 106, for instance to the one of the side walls 128 of the tub 104. In addition, the slide assembly 124 may be provided to transition the rack assembly, for example, the upper rack assembly 130 (FIG. 2), between an extended loading position (not pictured) and a retracted position (e.g., FIG. 3). As will be described in greater detail below, the slide assembly 124 may include an inner rail 123, an outer rail 125, and a soft close mechanism 200. Additionally or alternatively, slide assembly 124 may include a trigger 202 that includes a trigger support arm 204 and a trigger head 206. Further additionally or alternatively, slide assembly 124 may include a mount assembly 231. In some embodiments, the inner rail 123 may be attached to the tub 104, and more particularly, may be attached directly to one of the side walls 128 of the tub 104. For instance, the inner rail 123 may be attached to the tub side wall 128 via any suitable fastener. For example, the inner rail 123 may be attached (e.g., directly) to the tub side wall 128 via rivets, bolts, screws, welds, etc.

In some embodiments, the outer rail 125 extend between a first end 208 and a second end 213 approximately along the transverse direction T and may be slidably attached to the inner rail 123. When assembled, the slide assembly 124 may, thus, be capable of transitioning between the extended loading position and the retracted position. Additionally, in some embodiments, the outer rail 125 may include a plurality of slots 212 that may extend approximately along the vertical direction V. As shown, the slot 212 may be spaced apart approximately along the transverse direction T, for instance, spaced apart between the first end 208 of the outer rail 125 and the second end 213 of the outer rail 125. In some embodiments, for example, as illustrated in FIGS. 3 and 4, the slide assembly 124 may also include the intermediate rail 127. In such embodiments, the outer rail 125 may be slidably attached (e.g., directly) to the intermediate rail 127, which may be slidably attached (e.g., directly) to the inner rail 123. In addition, the exemplary slide assembly 124 may include an inner cage 214 that may include a first set of ball bearings 216 and an outer cage 218. The outer cage 218 may include a second set of ball bearings 220.

When assembled, the inner cage 214 may be positioned between the intermediate rail 127 and the inner rail 123. The first set of ball bearings 216 may facilitate the movement of the intermediate rail 127 relative to the inner rail 123. In addition, the outer cage 218 may be positioned between the intermediate rail 127 and the outer rail 125. The second set of ball bearings 220 may facilitate the movement of the outer rail 125 relative to the intermediate rail 127. In this regard, during movement of the slide assembly 124, for example, when moving the slide assembly 124 between the extended loading position and the retracted position, the intermediate rail 127 may be capable of sliding along the inner rail 123 approximately along or parallel to the transverse direction T. Additionally or alternatively, the outer rail 125 may be capable of sliding along the intermediate rail 127 approximately along or parallel to the transverse direction T.

In some embodiments, the slide assembly 124 includes a soft close mechanism 200 to dampen movement of the slide assembly 124. More particularly, the soft close mechanism 200 may be provided to control, dampen, or quiet the movement of components, for instance, the intermediate rail 127 or the outer rail 125, during a retraction operation of the slide assembly 124. A retraction operation of the slide assembly 124 may be an operation of the slide assembly 124 wherein the slide assembly 124 may be retracted from the extended loading position to the retracted position such as when a user of the dishwashing appliance 100 may retract a rack assembly, such as the upper rack assembly 130.

Generally, the soft close mechanism 200 may be provided as any suitable soft close slide. In some embodiments, the soft close mechanism 200 includes a saddle 224 and an actuator 226, for example, a spring, a damper, or a combination thereof, positioned within an actuator housing 228. Further, the saddle 224 may be coupled to the actuator 226 and may be configured as an intermediary component between the trigger 202 and the actuator 226. For instance, during a retraction operation of the slide assembly 124, the trigger head 206 may interact with the saddle 224 to engage the actuator 226. The actuator 226 may be configured to dampen the movement of the outer rail 125 relative to the inner rail 123 such that a "soft close" of the slide assembly 124 may be achieved. Specifically, in some instances, the actuator 226 may include a spring and a damper. For example, during the retraction operation of the slide assembly 124, the spring, which may have been held in compression, may release potential energy and the damper may create resistance for the spring during the retraction operation to slow down the movement of the slide assembly such that the "soft close" of the slide assembly 124 may be achieved.

Further, in some embodiments, the slide assembly 124 may include a mount assembly 231 that may be utilized to mount the soft close mechanism 200 to the outer rail 125. As illustrated in FIGS. 3 and 4, the mount assembly 231 may include an end cap 230 attached to the first end 208 of the outer rail 125, a second mount 232 attached to the outer rail 125, a first mount body 234, and a second mount body 236. Particularly, the soft close mechanism 200 may be mounted to the first mount body 234 and the second mount body 236 such that the soft close mechanism 200 is mounted to the outer rail 125. As used herein "mounted to" with regards to the soft close mechanism 200, the first mount body 234, and the second mount body 236 may refer to the soft close mechanism 200, or a portion thereof, being securely attached to or fixed to, such as or within, a portion of the first mount body 234, the second mount body 236, or a combination thereof.

It should be appreciated that the general orientation of the slide assembly 124 and the components thereof is provided by way of example only. For instance, in alternative exemplary embodiments, the slide assembly 124 may be oriented such that the soft close mechanism 200 and the trigger head 206 may be positioned atop of the slide assembly 124 approximately along the vertical direction V.

Figure 5:
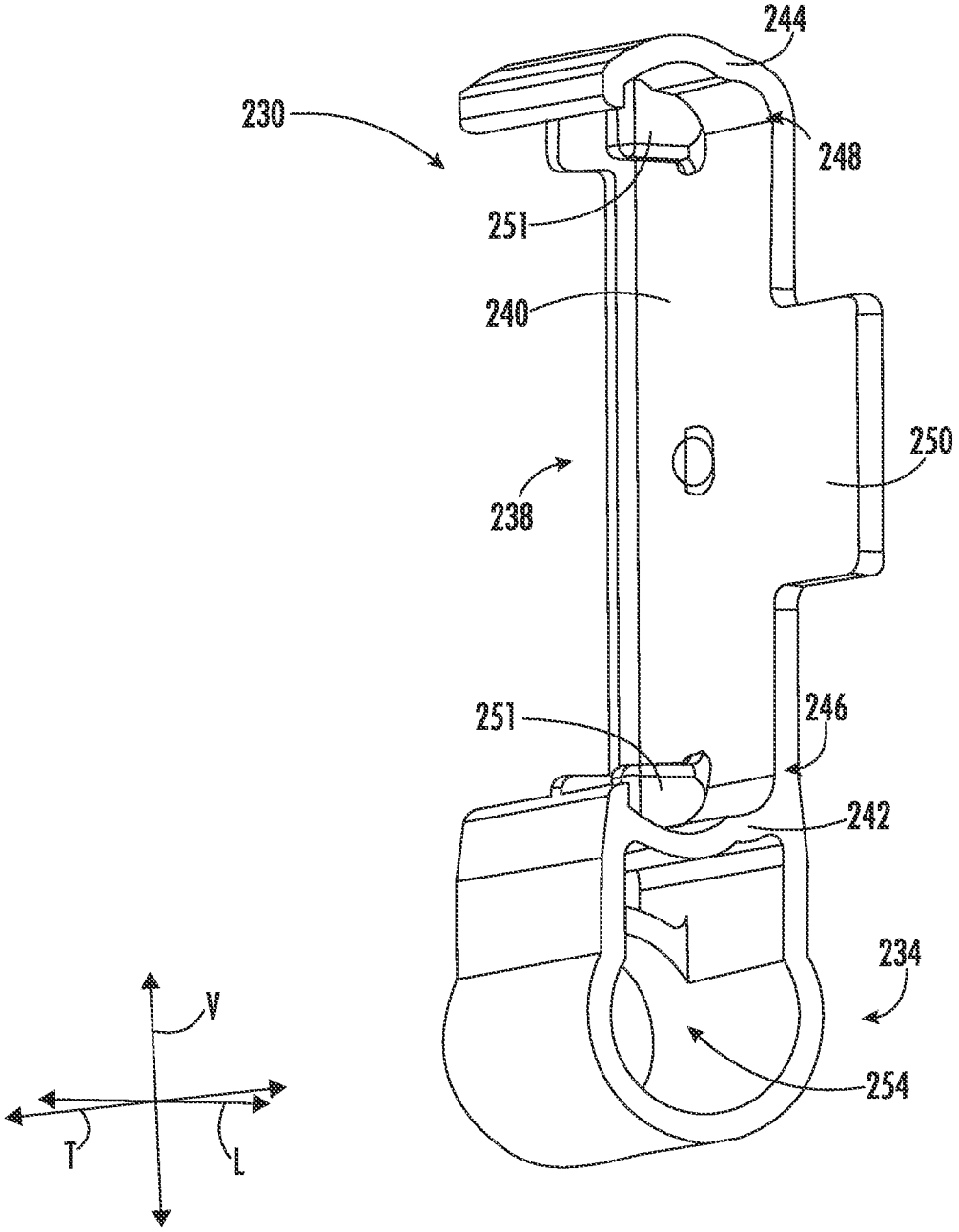
FIG. 5 provides a perspective view of an end cap of the exemplary slide assembly of FIG. 3.

Referring now to FIG. 5, a perspective view of the end cap 230 according to one or more exemplary embodiments of the present subject matter is provided. In some embodiments, the end cap 230 includes an end cap body 238 that includes a mount wall 240, a first lip 242, and a second lip 244. The mount wall 240 of the end cap body 238 may be extended between a first edge 246 and a second edge 248 approximately along the vertical direction V. Further, the end cap 230 may include one or more extrusions 251 that may be positioned at, or proximate to, the first edge 246 or the second edge 248. For instance, as illustrated in FIG. 5, the end cap 230 includes two extrusions 251, one positioned at the first edge 246 and one positioned at the second edge 248.

Further, as illustrated in FIG. 5, the second edge 248 may be positioned above the first edge 246 approximately along the vertical direction V. In addition, the mount wall 240 of the end cap body 238 may include a tongue 250 that may be positioned within a groove 252 of the outer rail 125, see, for example, FIG. 4. In some embodiments, the tongue 250 can be utilized to locate the end cap 230 to the groove 252 of the outer rail 125 such that the end cap 230 may be attached to the outer rail 125 at the first end 208 of the outer rail 125. For instance, the tongue 250 may fit into the groove 252 to align the first lip 242 and the second lip 244 with the outer rail 125. Additionally, the one or more extrusions 251 may fit within slots 253 of the outer rail 125 such that an interference fit may be formed between a respective extrusions 251 and a respective slot 253. In this regard, the end cap 230 may be locked in place relative to the outer rail 125.

Further, the first lip 242 of the end cap body 238 may be positioned at the first edge 246 of the mount wall 240 and the second lip 244 of the end cap body 238 may be positioned at the second edge 248 of the mount wall 240. The first lip 242 and the second lip 244 of the end cap body 238 may be configured and shaped such that they may be snapped onto the outer rail 125 (e.g., via a friction fit with the same).

In some embodiments, the first mount body 234 of the mount assembly 231 may be formed integrally with the end cap body 238. For instance, in some embodiments, the first mount body 234 and the end cap body 238 may be a monolithic piece that may be formed of any suitable material, for example, a rigid polymer material. In addition, the first mount body 234 may be positioned below the end cap body 238 approximately along the vertical direction V such that a housing cavity 254 of the first mount body 234 is positioned below the first lip 242 of the end cap body 238. The housing cavity 254 of the first mount body 234 may be complementary to a portion of the soft close mechanism 200. In some embodiments, housing cavity 254 is shaped and configured to receive a first end 256 of the soft close mechanism 200, for instance, to mount the soft close mechanism 200 to the outer rail 125.

Figure 6:
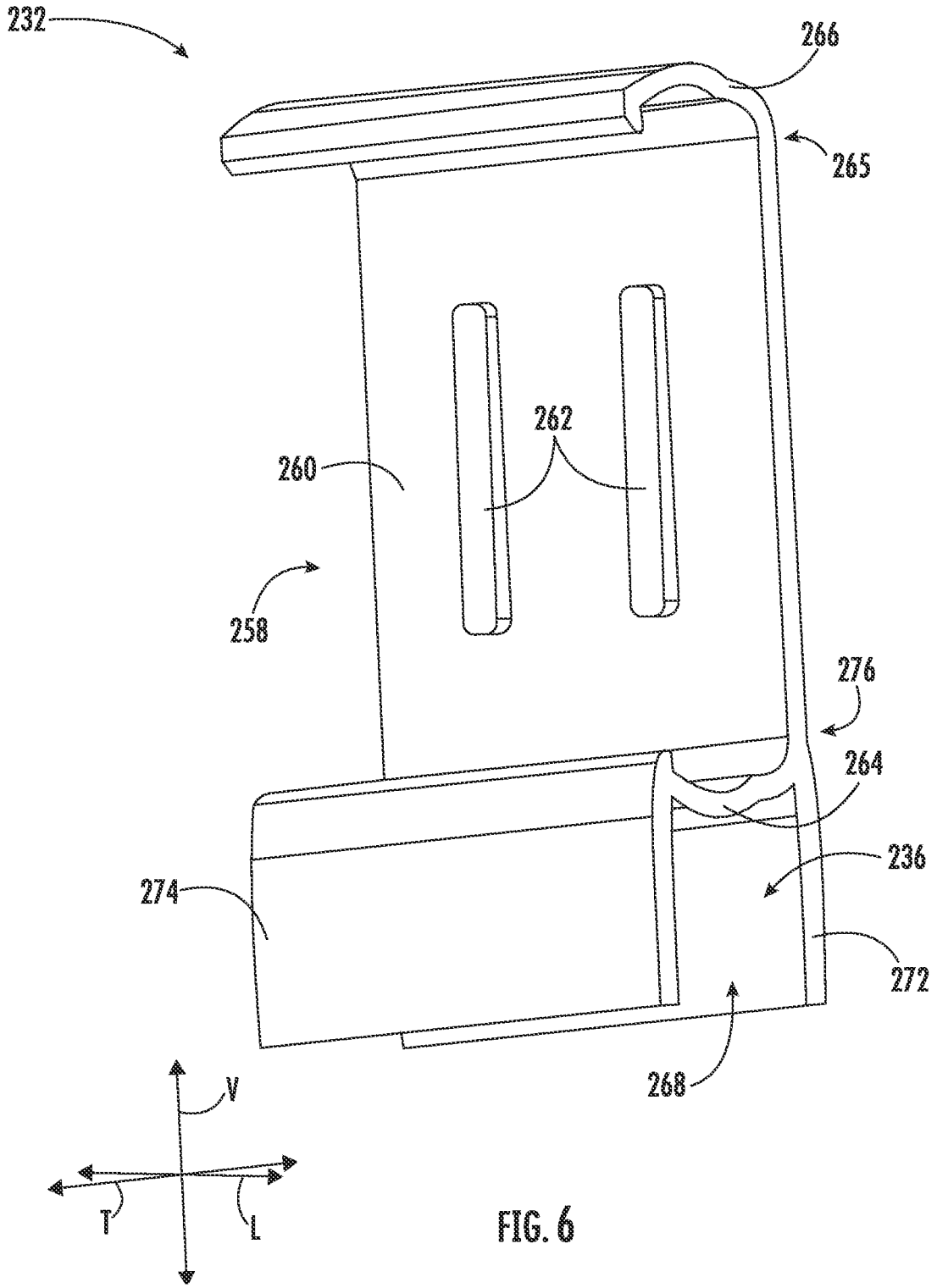
FIG. 6 provides a perspective view of a second mount of the exemplary slide assembly of FIG. 3.

In some embodiments, the second mount 232 of the mount assembly 231 is directly attached to the outer rail 125. For instance, referring now to FIG. 6, a perspective view of the exemplary second mount 232 according to one or more exemplary embodiments of the present subject matter is provided. The second mount 232 may generally include a main body 258 that may include a mount wall 260, one or more tabs 262 that may be protruded from the mount wall 260 approximately along the lateral direction L, a first lip 264, and a second lip 266. In some embodiments, the second mount 232 is attached to the outer rail 125 by the one or more tabs 262 each engaging with a discrete slot of the plurality of slots 212, see, for example, FIG. 4, of the outer rail 125. For instance, as illustrated in FIG. 6, the second mount 232 may include two tabs 262 that protrude from the mount wall 260 of the second mount 232. Each of the two tabs 262 may be engaged with a discrete slot of the plurality of slots 212 such that the second mount 232 may be attached to the outer rail 125. It should be appreciated that the one or more tabs 262 of the second mount 232 may be attached to any suitable slot of the plurality of slots 212.

In some embodiments, the second mount body 236 of the mount assembly 231 may be formed integrally with the main body 258. For instance, in some embodiments, the second mount body 236 and the main body 258 may be a monolithic piece that may be formed of any suitable material, for example, a rigid polymer material. In addition, the second mount body 236 may be positioned below the main body 258 approximately along the vertical direction V such that a housing cavity 268 of the second mount body 236 may be positioned below the first lip 264 of the main body 258. The housing cavity 268 of the second mount body 236 may be complementary to a portion of the soft close mechanism 200. In some embodiments, housing cavity 268 is shaped and configured to receive a second end 270 of the soft close mechanism 200, for instance, to mount the soft close mechanism 200 to the outer rail 125.

It should be appreciated that the position of the first mount body 234 and the second mount body 236 are provided by way of example only. For instance, in alternative exemplary embodiments, the first mount body 234 may be attached to the main body 258 of the second mount 232 and the second mount body 236 may be attached to the end cap body 238 of the end cap 230. In this regard, the first mount body 234 may be formed integrally with the main body 258 of the second mount 232 and the second mount body 236 may be formed integrally with the end cap body 238 of the end cap 230.

Figure 7:
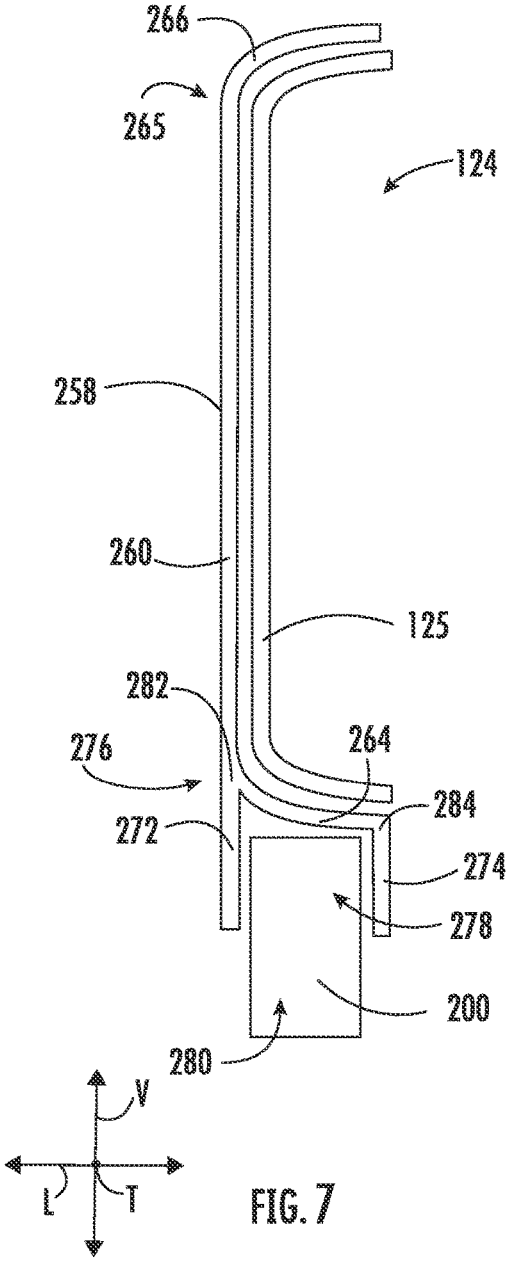
FIG. 7 provides a simplified cross-sectional view of the exemplary slide assembly of FIG.

Referring now to FIG. 7, a simplified cross-sectional view of the slide assembly 124 according to one or more exemplary embodiments of the present subject matter is provided. Specifically, FIG. 7 depicts a simplified cross-sectional view of the slide assembly 124 in a vertical orientation. In some embodiments, the second mount body 236 may include a first wall 272 and a second wall 274. For instance, the first wall 272 may extend from or be in line with, the first edge 276 of the mount wall 260 of the second mount 232. In this regard, the first wall 272 may be extended approximately along the vertical direction V from the mount wall 260.

In some embodiments, the first wall 272 and the second wall 274 define the housing cavity 268 that the soft close mechanism 200 may be mounted within. For instance, in some embodiments, the soft close mechanism 200 may include a first portion 278 and a second portion 280. The first portion 278 of the soft close mechanism 200 may be mounted entirely within the housing cavity 268 and the second portion 280 may be positioned outside of the housing cavity 268. In this regard, the first portion 278 of the soft close mechanism 200 may be the only portion of the soft close mechanism 200 that is mounted within the second mount body 236.

Particularly, the first portion 278 of the soft close mechanism 200 may correspond to a portion of the soft close mechanism 200 that may be used to mount or attach the soft close mechanism 200 to the first mount body 234, the second mount body 236, or a combination thereof. Further, the second portion 280 of the soft close mechanism 200 may correspond to the actuation components of the soft close mechanism 200, for example, the saddle 224 or the actuator 226, that may interact with, or may be influenced by, the trigger 202 during operation of the slide assembly 124, for instance, during a retraction operation of the slide assembly 124.

As illustrated in FIG. 7, the second mount body 236 may be positioned in a vertical orientation. In such embodiments, the soft close mechanism 200 may be mounted within the second mount body 236 in a vertical orientation. For instance, a vertical orientation of the soft close mechanism 200 may correspond to an orientation of the soft close mechanism 200 wherein the first portion 278 and the second portion 280 of the soft close mechanism 200 are positioned adjacent to each other approximately along the vertical direction V. In other words, the first portion 278 and the second portion 280 of the soft close mechanism 200 may be stacked atop one another such that the soft close mechanism 200 is orientated vertically. For example, as illustrated in FIG. 7, the second portion 280 of the soft close mechanism 200 may be positioned atop the first portion 278 of the soft close mechanism 200 approximately along the vertical direction V.

In some embodiments, the second lip may be attached to the second edge 265 of the mount wall 260 and the first lip 264 of the main body 258 may include a proximal end 282 that may be attached to the first edge 276 of the mount wall 260. In addition, the first lip 264 of the main body 258 may include a distal end 284. Further, in the vertical orientation, the second wall 274 of the second mount body 236 may be extended from the distal end 284 of the first lip 264 approximately along the vertical direction V. For instance, the second wall 274 of the second mount body 236 may be extended such that the second wall 274 is approximately parallel to the first wall 272. In this regard, the second mount body 236 and the housing cavity 268 defined by the second mount body 236 may be in the vertical orientation.

Figure 8:
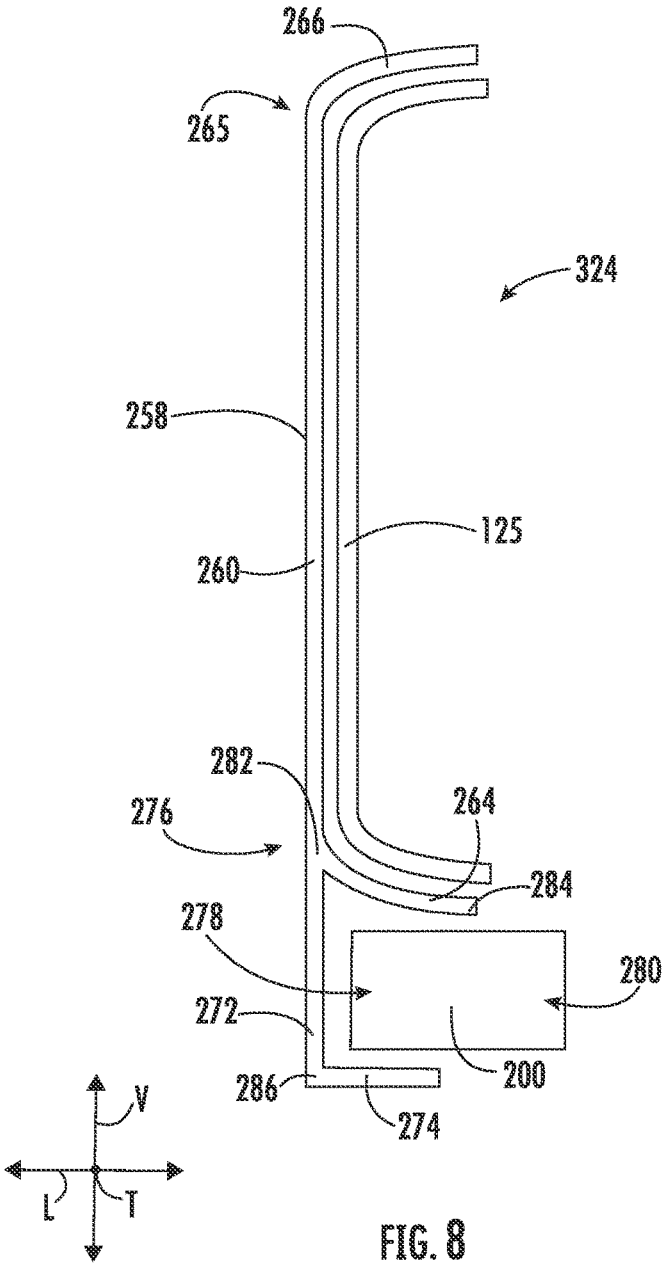
FIG. 8 provides a simplified cross-sectional view of an alternative slide assembly according to one or more exemplary embodiments of the present subject matter.

Referring now to FIG. 8, a simplified cross-sectional view of a slide assembly 324 in accordance with another exemplary aspect of the present subject matter may be provided. The exemplary slide assembly 324 of FIG. 8 may be configured in substantially the same manner as the exemplary slide assembly 124 of FIG. 7, and accordingly, the same or similar numbers may refer to the same or similar parts.

For example, the exemplary slide assembly 324 of FIG. 8 generally includes a mount assembly 231 that may include a second mount 232 attached to an outer rail 125. The second mount 232 may include a main body 258 that may include a mount wall 260, a first lip 264 attached to a first edge of the mount wall 260, and a second lip 266 attached to a second edge of the mount wall 260. The mount assembly 231 may also include a first wall 272 that may include a proximal end 282 attached to the first edge 276 of the mount wall 260 and a distal end 284. However, for the embodiment of FIG. 8, the second mount body 236 may be in a horizontal orientation. Particularly, the second wall 274 of the second mount body 236 may be extended from the distal end 284 of the first wall 272 approximately along the lateral direction L, for instance, such that the second wall 274 is positioned approximately perpendicularly to the first wall 272. In this regard, the horizontal orientation of the second mount body 236 may be formed.

As illustrated in FIG. 8, the soft close mechanism 200 may be mounted within the second mount body 236 in a horizontal orientation. For instance, a horizontal orientation of the soft close mechanism 200 may correspond to an orientation of the soft close mechanism 200 wherein the first portion 278 and the second portion 280 of the soft close mechanism 200 are positioned adjacent to each other approximately along the lateral direction L. In other words, the first portion 278 and the second portion 280 of the soft close mechanism 200 may be positioned side by side such that the soft close mechanism 200 is orientated horizontally. The horizontal orientation of the second mount body 236 may be utilized to accommodate different styles and orientations of trigger 202*s*, such as the trigger 202, and more particularly trigger heads, such as the trigger head 206.

Figure 9:
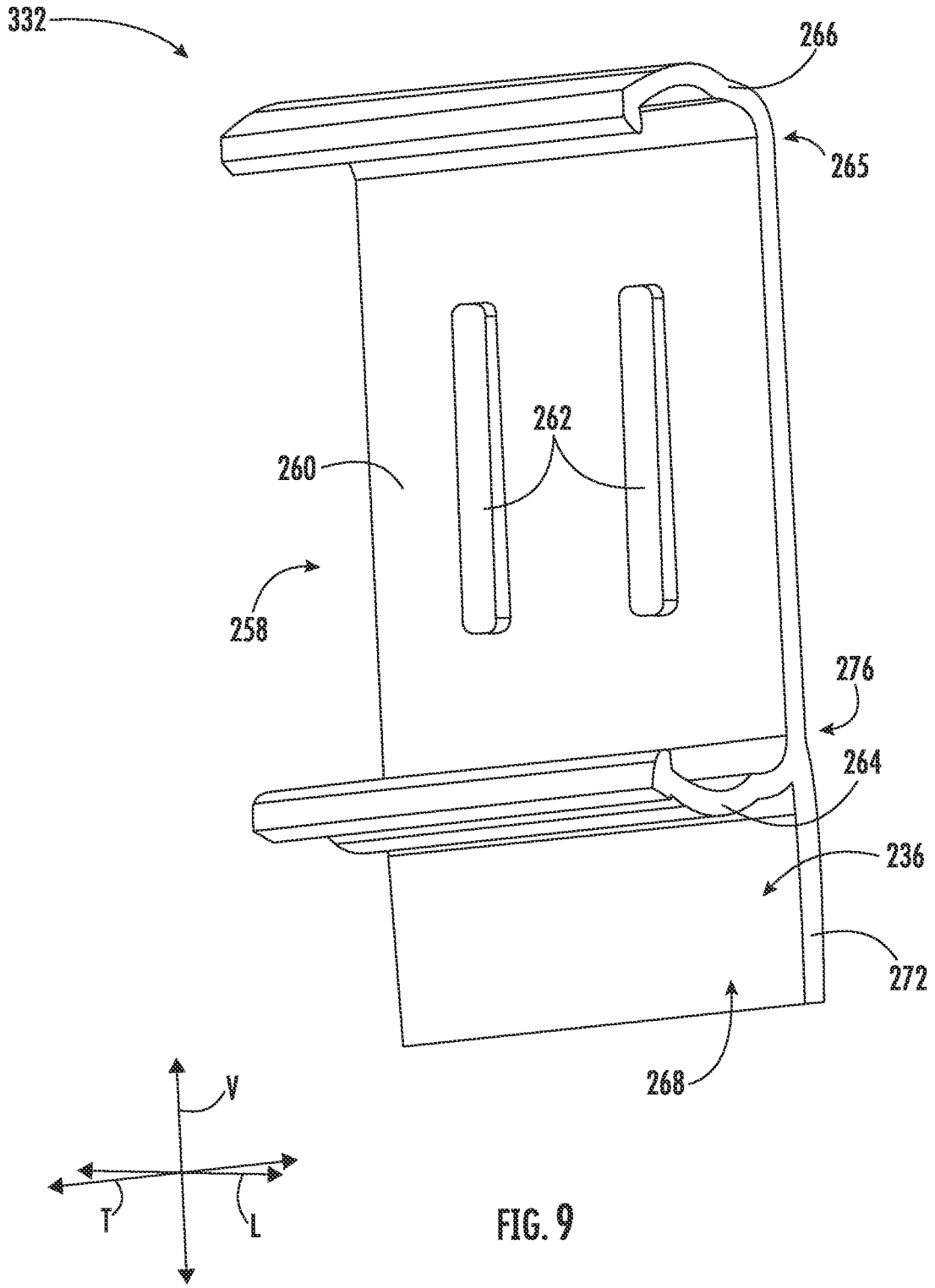
FIG. 9 provides a perspective view of an alternative second mount that may be incorporated into the exemplary slide assembly of FIG. 3.

Referring now to FIG. 9, a perspective view of a second mount 332 according to another exemplary aspect of the present subject matter is provided. The exemplary second mount 332 of FIG. 9 may be configured in substantially the same manner as the exemplary second mount 232 of FIG. 6, and accordingly, the same or similar numbers may refer to the same or similar parts.

For example, the exemplary second mount 332 of FIG. 9 generally includes a main body 258 that may include a mount wall 260, one or more tabs 262 that may be protruded from the mount wall 260 approximately along the lateral direction L, a first lip 264, and a second lip 266. Additionally, a second mount body 236 may be attached to the main body 258. However, for the embodiment of FIG. 9, the second mount body 236 second mount 332 may only include a first wall 272 that may extend from or be in line with a first edge 276 of the mount wall 260 of the second mount 332. In this regard, the first wall 272 may be extended approximately along the vertical direction V from the mount wall 260.

In such embodiments, a soft close mechanism such as the soft close mechanism 200 may be attached to the first wall 272. For instance, the soft close mechanism may be mechanically attached, e.g., with mechanical fasteners, to the first wall 272 of the second mount body 236.

Exemplary embodiments of the present subject matter advantageously provide a mounting assembly that may be utilized to mount a soft close mechanism to an outer rail of a slide assembly. The mount assembly 231 may advantageously allow the soft close mechanism to easily be mounted to the outer rail by taking advantage of existing geometries of the slide assembly, for instance, the outer rail slots and general shape. The end cap may advantageously function as a traditional end cap that may be attached to an exposed side of the outer rail, for instance, to protect a user of the slide assembly, and may also be utilized to locate or mount the soft close mechanism, for instance, via the first mount body or the second mount body. The second mount may advantageously be located and attached to the outer rail via the one or more protruded tabs that may fit into the plurality of slots of the outer rail.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, a lateral direction, and a transverse direction, the dishwashing appliance comprising:

a tub defining a wash chamber;

a rack assembly to load articles within the dishwashing appliance; and a slide assembly mounted to the tub to transition the rack assembly between an extended loading position and a retracted position, the slide assembly comprising:

an inner rail attached to the tub, an outer rail slidably attached to the inner rail, the outer rail extended between a first end and a second end approximately along the transverse direction, the outer rail comprising a first outer edge at the first end and a second outer edge at the second end, the outer rail defining one or more slots through top lip or a bottom lip of the outer rail, a soft close mechanism comprising an actuator to dampen movement of the slide assembly, and a mount assembly comprising:

an end cap attached to the first end of the outer rail to cover the first outer edge of the outer rail, the end cap comprising one or more extrusions positioned within a corresponding slot defined through the top lip or the bottom lip of the outer rail to lock the end cap in place relative to the outer rail, and a first mount body formed integrally with and positioned below the end cap, the first mount body comprising a housing cavity, wherein a portion of the soft close mechanism is mounted to the first mount body within the housing cavity of the first mount body.

2. The dishwashing appliance of claim 1, wherein the end cap comprises an end cap body, wherein the end cap body comprises a mount wall, a first lip, and a second lip, wherein the mount wall of the end cap body is extended between a first edge and a second edge approximately along the vertical direction, wherein the one or more extrusions comprises a first extrusion positioned at the first edge of the mount wall and a second extrusion positioned at the second edge of the mount wall, wherein the mount wall of the end cap body comprises a tongue positioned within a groove of the outer rail, wherein the first lip of the end cap body is positioned at the first edge of the mount wall, and wherein the second lip of the end cap body is positioned at the second edge of the mount wall.

3. The dishwashing appliance of claim 2, wherein the first mount body is attached to the first lip of the end cap.

4. The dishwashing appliance of claim 1, wherein the mount assembly further comprises a second mount body, wherein the second mount body comprises a housing cavity, wherein the soft close mechanism comprises a first end and a second end spaced apart approximately along the transverse direction, wherein the first end of the soft close mechanism is mounted to the first mount body within the housing cavity of the first mount body, and wherein the second end of the soft close mechanism is mounted to the second mount body within the housing cavity of the second mount body.

5. The dishwashing appliance of claim 4, wherein the mount assembly further comprises a second mount attached to the outer rail, the second mount comprising a main body comprising a mount wall, one or more tabs protruding from the mount wall, a first lip, and a second lip.

6. The dishwashing appliance of claim 5, wherein the outer rail comprises a plurality of slots defined therethrough, wherein the plurality of slots are positioned between the first end of the outer rail and the second end of the outer rail, and wherein each tab of the one or more tabs engaged with a discrete slot of the plurality of slots.

7. The dishwashing appliance of claim 5, wherein the second mount body is attached to the first lip of the second mount.

8. The dishwashing appliance of claim 5, wherein the second mount body comprises a first wall, wherein the mount wall comprises a first edge, wherein the first wall is extended from and in line with the first edge of the mount wall, wherein the soft close mechanism comprises a first portion and a second portion, wherein the second portion of the soft close mechanism comprises a saddle coupled to the actuator, and wherein the first portion of the soft close mechanism is mounted to the first wall.

9. The dishwashing appliance of claim 8, wherein the second mount body is in a vertical orientation, wherein the second mount body comprises a second wall, wherein the first lip of the main body comprises a proximal end attached to the first end of the mount wall and a distal end, wherein the second wall of the second mount body is extended from the distal end of the first lip, wherein the second wall is approximately parallel to the first wall, wherein the first wall and the second wall define a housing cavity, wherein the first portion of the soft close mechanism is mounted to the first wall and the second wall within the housing cavity, and wherein the second portion of the soft close mechanism is mounted outside of the housing cavity.

10. The dishwashing appliance of claim 8, wherein the second mount body is in a horizontal orientation, wherein the second mount body comprises a second wall, wherein the first wall comprises a proximal end attached to the first end of the mount wall and a distal end, wherein the second wall of the second mount body is extended from the distal end of the first wall, wherein the second wall is approximately perpendicular to the first wall, wherein the first wall and the second wall define a housing cavity, wherein the first portion of the soft close mechanism is mounted to the first wall and the second wall within the housing cavity, and wherein the second portion of the soft close mechanism is mounted outside of the housing cavity.

11. A slide assembly comprising:

an inner rail;

an outer rail slidably attached to the inner rail, the outer rail extended between a first end and a second end, the outer rail comprising a first outer edge at the first end and a second outer edge at the second end, the outer rail defining one or more slots through top lip or a bottom lip of the outer rail;

a soft close mechanism comprising an actuator to dampen movement of the slide assembly; and a mount assembly comprising:

an end cap attached to the first end of the outer rail to cover the first outer edge of the outer rail, the end cap comprising one or more extrusions positioned within a corresponding slot defined through the top lip or the bottom lip of the outer rail to lock the end cap in place relative to the outer rail, and a first mount body formed integrally with and positioned below the end cap, the first mount body comprising a housing cavity, wherein a portion of the soft close mechanism is mounted to the first mount body within the housing cavity of the first mount body.

12. The slide assembly of claim 11, wherein the end cap comprises an end cap body, wherein the end cap body comprises a mount wall, a first lip, and a second lip, wherein the mount wall of the end cap body is extended between a first edge and a second edge, wherein the one or more extrusions comprises a first extrusion positioned at the first edge of the mount wall and a second extrusion positioned at the second edge of the mount wall, wherein the mount wall of the end cap body comprises a tongue positioned within a groove of the outer rail, wherein the first lip of the end cap body is positioned at the first edge of the mount wall, and wherein the second lip of the end cap body is positioned at the second edge of the mount wall.

13. The slide assembly of claim 12, wherein the first mount body is attached to the first lip of the end cap.

14. The slide assembly of claim 11, wherein the mount assembly further comprises a second mount body, wherein the second mount body comprises a housing cavity, wherein the soft close mechanism comprises a first end and a second end, wherein the first end of the soft close mechanism is mounted to the first mount body within the housing cavity of the first mount body, and wherein the second end of the soft close mechanism is mounted to the second mount body within the housing cavity of the second mount body.

15. The slide assembly of claim 14, wherein the mount assembly further comprises a second mount attached to the outer rail, the second mount comprising a main body comprising a mount wall, one or more tabs protruded from the mount wall, a first lip, and a second lip.

16. The slide assembly of claim 15, wherein the outer rail comprises a plurality of slots defined therethrough, wherein the plurality of slots positioned between the first end and the second end, and wherein each tab of the one or more tabs engaged with a discrete slot of the plurality of slots.

17. The slide assembly of claim 15, wherein the second mount body is attached to the first lip of the second mount.

18. The slide assembly of claim 16, wherein the second mount body comprises a first wall, wherein the mount wall comprises a first edge, wherein the first wall is extended from and in line with the first edge of the mount wall, wherein the soft close mechanism comprises a first portion and a second portion, wherein the second portion of the soft close mechanism comprises a saddle coupled to the actuator, and wherein the first portion of the soft close mechanism is mounted to the first wall.

19. The slide assembly of claim 18, wherein the second mount body is in a vertical orientation, wherein the second mount body comprises a second wall, wherein the first lip of the main body comprises a proximal end attached to the first end of the mount wall and a distal end, wherein the second wall of the second mount body is extended from the distal end of the first lip, wherein the second wall is approximately parallel to the first wall, wherein the first wall and the second wall define a housing cavity, wherein the first portion of the soft close mechanism is mounted to the first wall and the second wall within the housing cavity, and wherein the second portion of the soft close mechanism is mounted outside of the housing cavity.

20. The slide assembly of claim 18, wherein the second mount body is in a horizontal orientation, wherein the second mount body comprises a second wall, wherein the first wall comprises a proximal end attached to the first end of the mount wall and a distal end, wherein the second wall of the second mount body is extended from the distal end of the first wall, wherein the second wall is approximately perpendicular to the first wall, wherein the first wall and the second wall define a housing cavity, wherein the first portion of the soft close mechanism is mounted to the first wall and the second wall within the housing cavity, and wherein the second portion of the soft close mechanism is mounted outside of the housing cavity.

* * * * *